United States Patent [19]

Huelsekopf

[11] 4,280,309

[45] Jul. 28, 1981

[54] WINDOW FRAME ASSEMBLY

[76] Inventor: Alfred G. Huelsekopf, R.R. No. 1, Newmarket ,Ontario, Canada

[21] Appl. No.: 100,831

[22] Filed: Dec. 6, 1979

Related U.S. Application Data

[63] Continuation of Ser. No. 957,922, Nov. 6, 1978, abandoned.

[51] Int. Cl.[3] ..... E06B 1/04; E04C 2/38

[52] U.S. Cl. ..... 52/212; 52/656

[58] Field of Search ..... 52/208, 209, 212, 308, 52/302–305, 309.1, 656

[56] References Cited

U.S. PATENT DOCUMENTS

| | | | |
|---|---|---|---|
| 2,275,686 | 3/1942 | Schonberg | 52/302 |
| 2,386,151 | 10/1945 | Trautvetter | 52/208 |
| 2,388,297 | 11/1945 | Slaughter | 52/309.1 |
| 2,883,717 | 4/1959 | Arnd | 52/302 |
| 2,993,242 | 7/1961 | Leisibach | 52/304 |
| 3,303,626 | 2/1967 | Brigham | 52/588 |
| 3,566,565 | 3/1971 | Pond | 52/208 |
| 3,866,369 | 2/1975 | Paull | 52/209 |
| 3,868,789 | 3/1975 | Gates | 264/322 |

*Primary Examiner*—James L. Ridgill, Jr.

*Attorney, Agent, or Firm*—Fetherstonhaugh & Co.

[57] ABSTRACT

A window frame assembly for use in a window opening which extends from one side of a body such as a door, a wall or the like to the other side thereof comprising a preassembled first frame which includes a header member, side rail members and a sill member arranged and proportioned to fit within said window opening, each of said members comprising a transverse wall adapted to extend between the sides of said body, said transverse wall having first and second longitudinally extending sides, a first flange projecting outwardly from said transverse wall at said first side thereof for engagement with said one side of said body to prevent direct removal of said first frame from said opening through said other side, means located inwardly of said transverse wall for mounting at least one window unit within said first frame, and first locking means extending longitudinally of said frame member, said first locking means being engageable from said other side of said body in use, and a locking rail for each of said members comprising a longitudinally extending second flange having second locking means carried thereby, said second locking means being adapted to engage said first locking means of said first frame.

2 Claims, 2 Drawing Figures

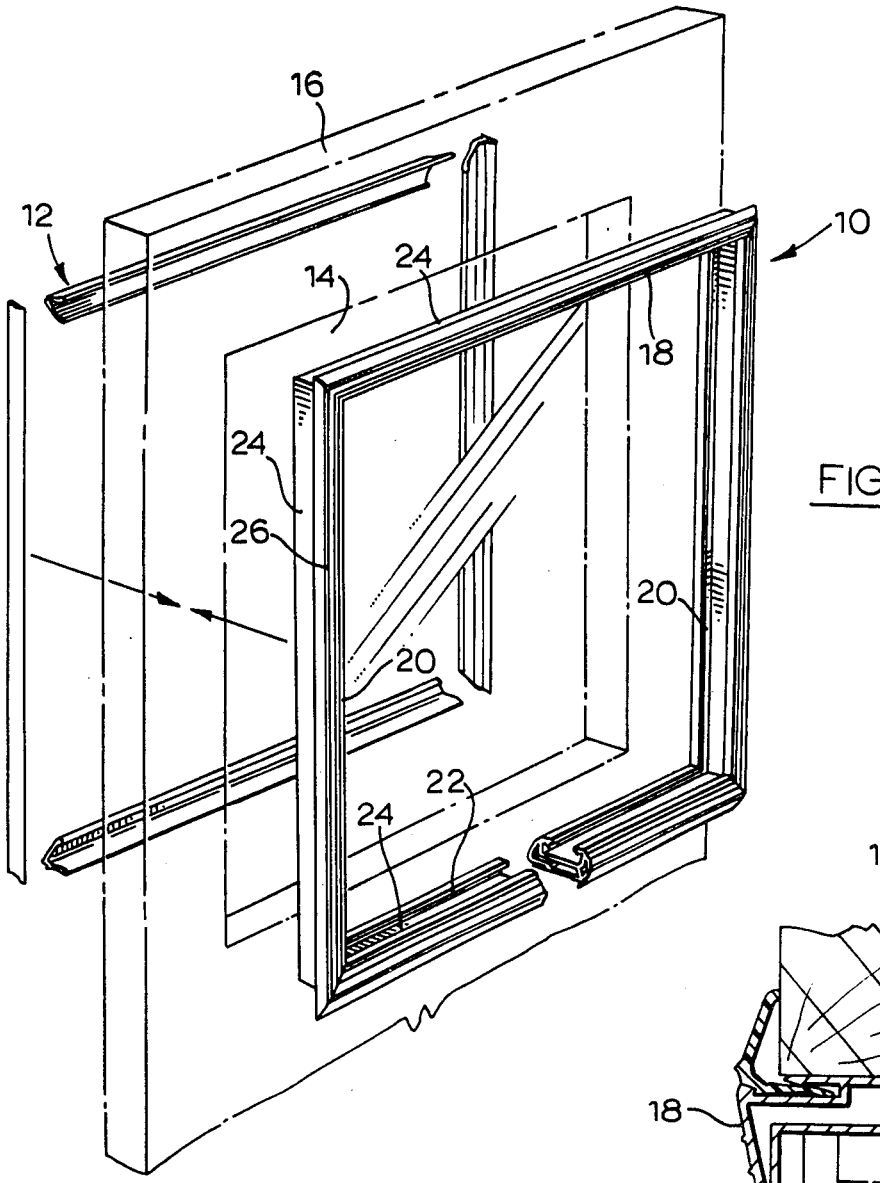
FIG.1
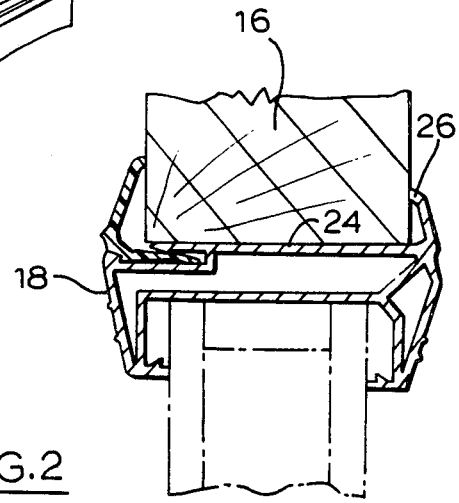
FIG.2
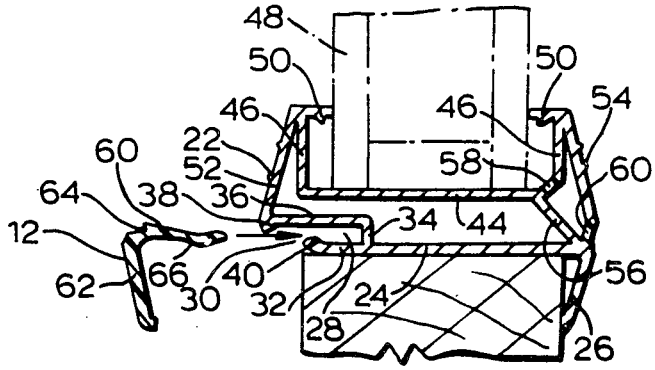

WINDOW FRAME ASSEMBLY

This is a continuation of application Ser. No. 957,922, filed Nov. 6, 1978, now abandoned.

This invention relates to window frame assemblies. In particular, this invention relates to a window frame assembly which includes a preassembled first frame.

PRIOR ART

In a window frame of the type which is commonly mounted in an opening formed in a door, the header member, side rail members and sill member may each be in the form of a generally H-shaped extrusion which can be snapped into position over an edge of the door at the window opening. The extruded material is cut to the required sill, header and side rail lengths and these lengths are mounted in the opening one at a time. It is customary to first mount the sill member and header members and thereafter to mount the side rail members. In order to position the side rail members in an end-to-end abutting relationship with the sill and header members, it is necessary to bow the side rail members lengthwise. Before installing the members, a sealing compound is located at each corner so that the interface will be sealed a each corner when the members are installed. Considerable difficulty is experienced in obtaining a satisfactory seal by means of this conventional calking system. Because of these difficulties, it is also common practice to weld the abutting ends together at the interface by means of a solvent adhesive or the like. Thus, it will be apparent that this method of assembly and installation is time consuming and it requires considerable skill and care on the part of the mechanic responsible for the installation in order to obtain a satisfactory weathertight installation. A further difficulty expertienced in using the "snap-in type" frame elements is that the window opening in which they are mounted must be cut very accurately to ensure that the window will function properly.

The H-shaped frame forming members have one channel for receiving the edge of the body in which the window opening is formed and the other channel receiving a window unit. The tolerances which are permitted in the thickness of doors and wall units in which window frames are to be mounted are quite substantial. This creates problems when the H-shaped section is mounted in a window opening in which the door or wall is of the maximum allowable thickness. Under these conditions, the walls of the channel in which the oversize body is mounted are deflected outwardly and this outward deflection is translated into an inward deflection of the walls of the inner channel. When a sliding window unit or a removable window unit is mounted within the frame, difficulty can be experienced in operating the window unit effectively because of the inward deflection of the side arms of the channel member.

In another prior frame construction, two substantially identical half-frame members are manufactured and these half-frames are mounted in a sandwich type arrangement. Each half-frame member has integrally connected side rail header and sill members proportioned to fit a preselected window opening. The two half-frame members are arranged one on either side of the window opening and are inserted therein from opposite sides and secured to one another by fastening means extending transversely therebetween. Considerable difficulty is experienced in attempting to install these window units because it is necessary to use a plurality of fastening elements such as screws which are either screwed into the underlying support or extend transversely between the oppositely disposed frame members. Furthermore, these units are generally formed in an injection moulding process so that they are not sufficiently flexible to be mounted without the aid of calking to prevent moisture penetration. Thus, it is necessary to provide a calking compound along the entire periphery of the outer framing member in order to obtain a watertight installation. The manufacture of these members by an injection moulding process is expensive by reason of the expense involved in the preparation of dies suitable for use in the injection moulding process. Furthermore, when the window frame is required to support an operating window, it is not possible to injection mould a profile suitable for providing adequate support for a movable window or the tracks required for mounting a movable window or the like. Thus, it will be apparent that a sandwich-type window assembly, while simple to locate in a window opening, has many undesirable features.

I have designed a window frame member which is simple to manufacture and to install in a window opening. It includes two components which are interlockable to secure the frame member in an operable position. The first component includes a transverse wall member and a flange which projects outwardly from the transverse wall member to form one side of a one edge of the transverse wall. The second component is a locking rail which has a second flange and a locking tongue adapted to be inserted into said locking disposed opposite the first flange.

I have discovered that the mounting of the window mounting chamber. A first locking chamber is provided at one edge of the transverse wall. The second component is a locking rail which has a second flange and a locking tongue adapted to be inserted into said locking chamber to secure the second flange in a position disposed opposite the first flange. Frame can be greatly simplified and the problems resulting from the distortion of the extruded frame units can be overcome by providing a locking rail which can be mounted after the frame members are positioned in a window opening. The use of the locking rail permits the header sash and side rails to be preassembled to a frame configuration which can be inserted into a window opening from one side. Because the frame can be preassembled, the abutting end faces of each of the members can be welded or bonded to one another in a manner which will provide a water-tight seal, thus avoiding the necessity of calking the frame after it is installed. Furthermore, the locking rail is preferably constructed as the inner flange member and is designed and mounted on the preassembled frame member in a manner so as to permit it to flex to accomodate variations in the thickness of the body on which the window frame is mounted without causing inward deflection of the legs which form the window mounting channel.

The fact that it is possible to preassemble the header, rail and sill members and to seal the abutting end faces in a manufacturing operation has numerous additional advantages over those described above. It provides for ease of installation and it provides an exterior appearance which is free from any visible securing screws. Furthermore, it improves the heat insulating characteristics of the window unit as a whole because the efficiency of the connection between the members can be carefully controlled in a manufacturing process. By mounting the window so that the outwardly directed flange of the preassemble frame unit is located at the outer face of the window opening, a completely sealed outer face is presented to the environment from which it is desired to insulate the interior space of a room or the like.

SUMMARY OF INVENTION

According to one aspect of the present invention, there is provided a window frame assembly for use in a window opening which extends from one side of a body such as a door, a wall or the like to the other side thereof comprising a preassembled first frame which includes a header member, side rail members and a sill member arranged and proportioned to fit within said window opening, each of said members comprising, a transverse wall adapted to extend between the sides of said body, said transverse wall having first and second longitudinally extending sides, a first flange projecting outwardly from said transverse wall at said first side thereof for engagement with said one side of said body to prevent direct removal of said first frame from said opening through said other side, means located inwardly of said transverse wall for mounting at least one window unit within said first frame and first locking means extending longitudinally of said frame member, said first locking means being engageable from said other side of said body in use, and a locking rail for each of said members comprising a longitudinally extending second flange having second locking means carried thereby, said second locking means being adapted to engage said first locking means of said first frame when said first frame is located in a window opening as aforesaid, to secure said locking rail means with respect to said first frame member with said second flange disposed opposite said first flange for engagement with said other side of said body to clamp said body between said first and second flanges and securely mount said window frame assembly in said window opening in use.

The invention will be more clearly understood after reference to the following detailed specification read in conjunction with the drawings wherein, FIG. 1 is a pictorial view of a window frame illustrating a first step in the mounting of the assembly in a window opening: and FIG. 2 is a cross-sectional view through two window frame members, one of which is shown fully assembled and one of which is shown partially assembled.

With reference to the drawings, the reference numeral 10 refers generally to a preassembled first frame and the reference numeral 12 refers generally to a locking rail suitable for use in securing the preassembled first frame 10 in a window opening 14 in a body 16 of a door, a wall or the like.

The preassembled first frame consists of a header member 18, a pair of oppositely disposed side rail members 20 and a sill member 22. In the embodiment illustrated in the drawings, the header, side rail and sill members 22 are of identical construction and each have a transverse wall 24 and a first flange 26 projecting outwardly therefrom. The preassembled first frame 10 is proportioned so that the transverse walls 24 will fit freely within the opening 14 with the first flanges projecting outwardly therefrom in an overlying relationship with respect to an outer face of the body 16. Thus it will be seen that the preassembled first frame member can be inserted from one side of the window opening and is prevented from removal to the other side by the first flanges 26. The abutting end faces of the members 18, 20 and 22 may be sealed by suitable adhesive which may be in the form of a solvent which will effectively permit welding of the abutting faces together so that the first frame may be prefabricated to a substantially unitary body. By welding or sealing along the abutting faces at the joint between each frame member, the passage of moisture through the frame at the joints is prevented. By preassembling the first frame member, it extremely simple to install the first frame member as it merely slides into the opening 14.

In the preferred embodiment, the sill members, header member and side rail members are of the same cross-sectional configuration and have a locking channel 28 extending longitudinally thereof which opens outwardly at the second edge of the transverse wall 24 at longitudinally extending passage 30. The locking channel 28 is bounded by a marginal edge portion 32 of the transverse wall 24, an end wall 34 and a side wall 36. A locking shoulder 38 is formed on the side wall 36 and has an inclined face directed inwardly of the channel 28. A further locking shoulder 40 is located on the marginal edge portion 32 on the opposite side of the channel and spaced laterally inwardly from the shoulder 38.

Each frame member is adapted to permit mounting of a window unit inwardly thereof and to this end it is formed with a second transverse wall 44 which has side walls 46 projecting inwardly therefrom to cooperate therewith to provide a generally U-shaped channel for receiving a window unit 48. The side walls 46 have resilient flanges 50 projecting transversely inwardly therefrom for engagement with the sides of the window unit. Facing walls 52 and 54 are located at the inner and outer sides of the frame members and extend longitudinally thereof. A web 56 extends angularly between transverse walls 24 and 44. It will be noted that the transverse wall 44 is inclined toward the transverse wall 24 in a direction toward the outer edge thereof. The angular inclination of the wall 44 serves to drain any accumulated moisture toward the outside of the frame member wherein it is permitted to drain through drain passages 58 and 60.

The locking rail members 12 each have a locking tongue 60 and a second flange member 62 arranged in a generally L-shaped configuration, the locking tongue 60 has locking shoulders 64 and 66 extending longitudinally thereof for engagement with the locking shoulders 38 and 40 of the locking channel 28 respectively. It will be understood that locking rails of different proportions may be made available to accomodate bodies of different thickness. It will be apparent that the distance from the locking shoulder 64 to the second flange member 62 may differ in different sets of locking rails thereby providing different channel widths to accomodate door or walls of different thickness.

In use, the preassembled first frame is mounted in the window opening as previously described and thereafter the locking rails are inserted into the locking channel 28 in each frame member. The locking tongue of each locking rail is inserted into its locking channel 28 by way of passage 30. The preassembled first frame member and associated locking rails are proportioned such that if the frame assembly was assembled in a relaxed configuration with the locking shoulders interlocked, the distance between the first and second side walls 26 and 62 when in the relaxed configuration is less than the minimum thickness of the body 16 in which the assembly is to be mounted so that the side walls 26 and 62 will always be urged to move away from one another by the body on which they are mounted in use. The clamping force applied by the second flange 62 to the body serve to urge the shoulders 38 and 64 and shoulders 40 to 66 into locking engagement.

From the foregoing it will be apparent that the first frame unit can be efficiently assembled in a manufacturing operation with the various frame members correctly aligned and sealed at their abutting end faces to form a substantially unitary body. The preassembled first frame unit can be very easily inserted into a window frame and the locking rails can be very easily mounted within the locking channels to secure the window frame assembly as a whole in the window opening.

Various modifications of the present invention will be apparent to those skilled in the art without departing from the scope of the invention. For example, the means located inwardly of the transverse wall for mounting the window unit may be extending longitudinally thereof for engagement with the locking shoulders 38 and 40 of the locking channel 28 respectively.

In use, the preassembled first frame is mounted in the window opening as previously described and thereafter the locking rails are inserted into the locking channels 28 in each frame member. The locking tongue of each locking rail is inserted into its locking channel 28 by way of passage 30. The preassembled first frame member and associated locking rails are proportioned such that if the frame assembly was assembled in a relaxed configuration with the locking shoulders interlocked, the distance between the first and second side walls 26 and 62 when in the relaxed configuration is less than the minimum thickness of the body 16 in which the assembly is to be mounted so that the side walls 26 and 62 will always be urged to move away from one another by the body on which they are mounted in use. The clamping force applied by the second flange 62 to the body serve to urge the shoulders 38 and 64 and shoulders 40 and 66 into locking engagement.

From the foregoing it will be apparent that the first frame unit can be efficiently assembled in a manufacturing operation with the various frame members correctly aligned and sealed at their abutting end faces to form a substantially unitary body. The preassembled first frame unit can be very easily inserted into a window frame and the locking rails can be very easily mounted within the locking channels to secure the window frame assembly as a whole in the window opening.

Various modifications of the present invention will be apparent to those skilled in the art without departing from the scope of the invention. For example, the means located inwardly of the transverse wall for mounting the window unit may be designed to permit one or more window units to be located therein. It may be designed to permit two sliding window units to be located therein and it may include additional components for use in securing the window units therein as required in use.

What I claim as my invention is:

1. A window frame assembly for use in a rectangular window opening which extends from one side of a body such as a door, a wall or the like to the other side thereof comprising:

(a) a preassembled rectangular shaped frame which includes a header member, side rail members and a sill member which are secured to one another and sealed in an end-to-end relationship and arranged and proportioned to fit within a rectangular window opening, each frame member comprising, (i) a composite transverse wall proportioned to extend between the sides of said body, said composite transverse wall comprising first and second wall panels which extend transversely and are interconnected at first and second side edges of said composite transverse wall to form a substantially rigid structure having a chamber formed inwardly thereof, (ii) a first flange projecting outwardly from said first wall panel at said first side edge thereof for engagement with said one side of said body to prevent direct removal of said first frame from said opening through said other side, (iii) window mounting means on said second wall panel extending inwardly therefrom, said window mounting means being adapted to retain at least one window unit within said first frame, and (iv) a first locking channel formed in said second wall panel, said first locking channel extending longitudinally of and opening at said second side edge of said second wall panel to be engageable from said other side of said body in use, and (b) a locking rail for each of said members comprising a longitudinally extending second flange and a longitudinally extending locking tongue arranged in an L-shaped configuration, said locking tongue being adapted to be insertable within said locking channel to dispose said second flange opposite said first flange for engagement with said other side of said body to clamp said body between said first and second flanges, (c) interlocking means on said locking tongue and in said locking channel for releasably securing said locking tongue within said locking channel in use.

2. A window frame assembly as claimed in claim 1 wherein said second transverse wall has a first section extending from said first side edge and terminating at a free edge at the open end of said channel, a second section extending inwardly of said chamber from a point spaced a substantial distance from said free edge of said first section and a third section extending from the second section to the second edge of said composite transverse wall and projecting outwardly from the free edge of said first section, said interlocking means comprising a first locking shoulder formed on said third section transversely outwardly from said free edge of said first section, said first shoulder projecting inwardly of said locking channel at the entrance to said channel, said locking tongue having a second locking shoulder formed thereon adapted to abut said first locking shoulder when said locking tongue is disposed within said channel.

* * * * *